US008476835B1

(12) United States Patent
Parisi et al.

(10) Patent No.: US 8,476,835 B1
(45) Date of Patent: Jul. 2, 2013

(54) AUDIO CONTROLLED LIGHT FORMED CHRISTMAS TREE

(76) Inventors: Joseph Salvatore Parisi, Delray Beach, FL (US); Joseph Parisi, Boca Raton, FL (US)

( * ) Notice: Subject to any disclaimer, the term of this patent is extended or adjusted under 35 U.S.C. 154(b) by 327 days.

(21) Appl. No.: 12/695,118

(22) Filed: Jan. 27, 2010

Related U.S. Application Data

(60) Provisional application No. 61/206,085, filed on Jan. 27, 2009.

(51) Int. Cl.
*H05B 37/00* (2006.01)
*H05B 39/00* (2006.01)

(52) U.S. Cl.
USPC ..... 315/185 S; 315/185 R

(58) Field of Classification Search
USPC ..... 315/185 R, 185 S, 291, 186, 191–193, 315/292–295, 297–298, 306, 312; 362/806, 362/605, 644, 653
See application file for complete search history.

(56) References Cited

U.S. PATENT DOCUMENTS

| | | | | |
|---|---|---|---|---|
| 6,386,728 | B1 * | 5/2002 | Colonna | 362/123 |
| 6,491,516 | B1 * | 12/2002 | Tal et al. | 431/253 |
| 7,247,076 | B2 * | 7/2007 | Dang et al. | 446/102 |
| 7,784,961 | B1 * | 8/2010 | Rawlings | 362/123 |
| 7,916,877 | B2 * | 3/2011 | Goldberg et al. | 381/123 |

* cited by examiner

*Primary Examiner* — Minh D A
(74) *Attorney, Agent, or Firm* — Allen, Dyer, Doppelt, Milbrath & Gilchrist, P.A.

(57) ABSTRACT

A Christmas tree decorative enhancing system provides a lighting display that is choreographed to an audio file and respective output. Each of a series of light strands are in signal communication with a respective output port on a controller. The controller integrates a storage device reader, a digital audio decoding integrated circuit, an operational controller data file decoding circuit, an output controller circuit, and a power regulation circuit. An audio data file is merged with an operational controller data file and stored in a portable digital data storage device. The controller decodes the merged file, generates an audio output signal, and drives the output controller circuit to illuminate one or more light strands in a choreographed manner in concert with the audio output. Two or more systems can be in wireless, signal communication to operate in tandem. The system can be provided using the light strands to form a tree-shape, or the lights can be placed into an existing tree.

20 Claims, 23 Drawing Sheets

AUDIO CONTROLLED LIGHT FORMED CHRISTMAS TREE

CROSS-REFERENCE TO RELATED APPLICATION

This Non-Provisional Utility application claims the benefit of co-pending U.S. Provisional Patent Application Ser. No. 61/206,085, filed on Jan. 27, 2009, which is incorporated herein in its entirety.

FIELD OF THE INVENTION

The present disclosure generally relates to an apparatus and method for a enhancing a Christmas tree display. More particularly, the present disclosure relates to a Christmas tree display having a plurality of lights, the lights being sequenced and choreographed to an audio output.

BACKGROUND OF THE INVENTION

Christmas displays have been a customary pastime for centuries. The center of Christmas displays are Christmas trees and a Nativity scene.

According to Christian lore, the Christmas tree is associated with St Boniface and the German town of Geismar. Sometime in St Boniface's lifetime (c. 672-754) he cut down the tree of Thor in order to disprove the legitimacy of the Norse gods to the local German tribe. St. Boniface saw a fir tree growing in the roots of the old oak. Taking this as a sign of the Christian faith, he said " . . . let Christ be at the center of your households . . . " using the fir tree as a symbol of Christianity.

The custom of erecting a Christmas tree can be historically traced to 16th century Northern Germany and their settlements in the Baltic region. According to the first documented uses of a Christmas tree in Estonia, in 1441, 1442, and 1514 the Blackheads erected a tree for the holidays in their brotherhood house in Reval (now Tallinn). At the last night of the celebrations leading up to the holidays, the tree was taken to the Town Hall Square where the members of the brotherhood danced around it. In 1584, the pastor and chronicler Balthasar Russow wrote of an established tradition of setting up a decorated spruce at the market square where the young men "went with a flock of maidens and women, first sang and danced there and then set the tree aflame". In that period, the guilds started erecting Christmas trees in front of their guildhalls: Ingeborg Weber-Kellermann (Marburg professor of European ethnology) found a Bremen guild chronicle of 1570 which reports how a small tree was decorated with "apples, nuts, dates, pretzels and paper flowers" and erected in the guild-house, for the benefit of the guild members' children, who collected the dainties on Christmas Day.

Christmas tree displays have become significant traditions and major events at many locations, such as the Rockefeller Center Christmas Tree in New York City and the large Christmas tree at Victoria Square in Adelaide. During most of the 1970s and 1980s, the largest Christmas tree in the world was put up every year on the property of The National Enquirer in Lantana, Fla. This tradition grew into one of the most spectacular and celebrated events in the history of Southern Florida, but was discontinued on the death of the paper's founder in the late 1980s.

Norway also annually gifts a Christmas tree to Washington D.C. as a symbol of friendship between Norway and the US and as an expression of gratitude from Norway for the help received from the US during World War II. The United States' National Christmas Tree is lit each year on the South Lawn of the White House. Today, the lighting of the National Christmas Tree is part of what has become a major holiday event at the White House.

Christmas trees were originally decorated with natural objects. Over time, the decorations have evolved into trinkets or other ornaments, lights, bows, garland, a tree topper, and the like. The larger, more articulated displays, such as those presented above, strive for uniqueness to continue to attract visitors.

The challenge continues to conceive and develop more desirable Christmas tree decorations and displays to provide a memorable experience, and at larger commercial displays, attracting more visitors.

SUMMARY OF THE INVENTION

The basic inventive concept provides an embellished Christmas tree decoration, the decoration comprising a series of light strands choreographed to a sound file wherein the operative code for the light sequencing is merged within the sound file into a single file.

A first aspect of the present invention provides a Christmas tree decoration comprising:

a controller integrating the following circuits:

an interface providing signal communication between the controller and a portable storage device, a digital audio decoding integrated circuit providing an audio output signal, an output controller circuit for controlling an electrical signal to an series of controller electrical connections, and a power regulation circuit;

an audio output device for producing a sound pressure wave; and a series of light strands having an electrical connector which mates with the controller electrical connections.

A second aspect of the present invention further integrates the controller into a tree top subassembly.

In another aspect, the controller electrical connections are provided within the tree top subassembly.

In yet another aspect, the Christmas tree decoration further comprises a column support, wherein the column support is a series of interlocking poles.

In yet another aspect, the Christmas tree decoration further comprises a stand or base, wherein the column support is supported by the base.

In yet another aspect, a series of base arm subassemblies are attached to the base.

In yet another aspect, the series of base arm subassemblies are pivotally attached to the base, allowing the user to rotate the arm subassemblies into a storage configuration. Each light strand spans between the tree top subassembly and a distal end of each base arm subassembly.

In yet another aspect, each light strand spans between the tree top subassembly and a stake provided into the ground.

In yet another aspect, the tree controller operational file comprises a sequence file and an audio file merged into a single tree operational controller data file.

In yet another aspect, the Christmas tree decoration is operably controlled via a wireless remote control.

In yet another aspect, a first Christmas tree decoration and a second Christmas tree decoration are synchronized via a wireless communication.

In yet another aspect, the controller includes a signal interface

A method aspect of the present invention provides a Christmas tree display, the method comprising the steps of:

orienting a series of lights in at least one of in a form factor representative of a Christmas tree and onto a Christmas tree;

providing signal communication between the series of lights and a system controller;

decoding a tree operational controller data file into an audio file and a sequence controller file;

providing an audio output in accordance with the audio file; and operating the series of lights in accordance with a sequence controller file.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

Figure 1:
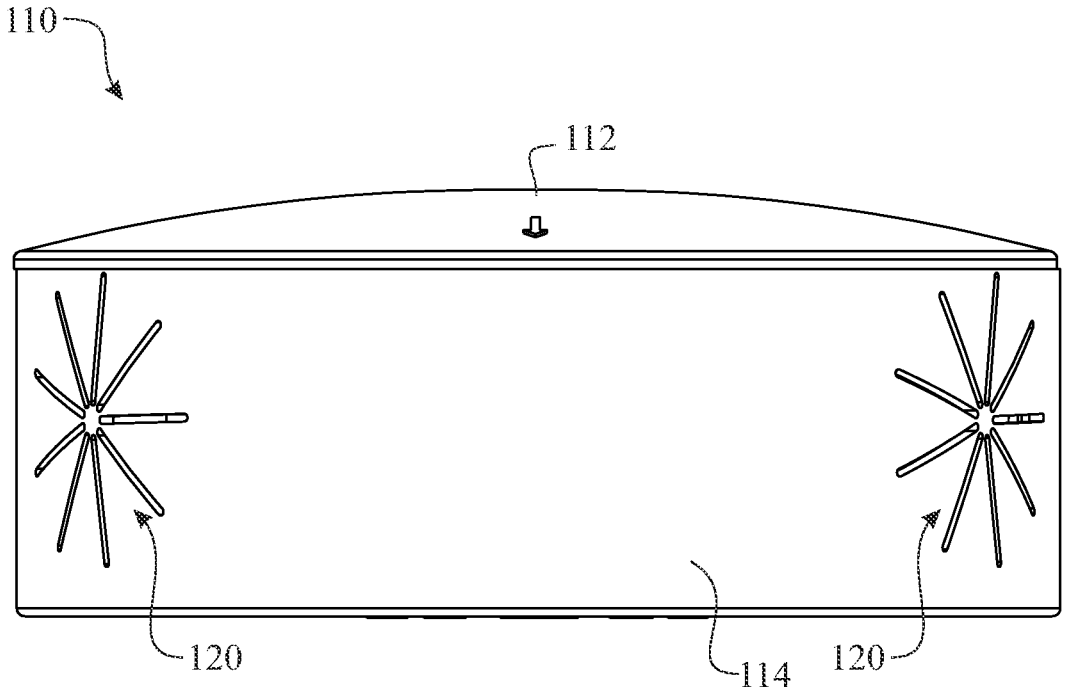
FIG. 1 presents a side elevation view of an exemplary tree top subassembly for use in conjunction with a light formed Christmas tree.
Figure 2:
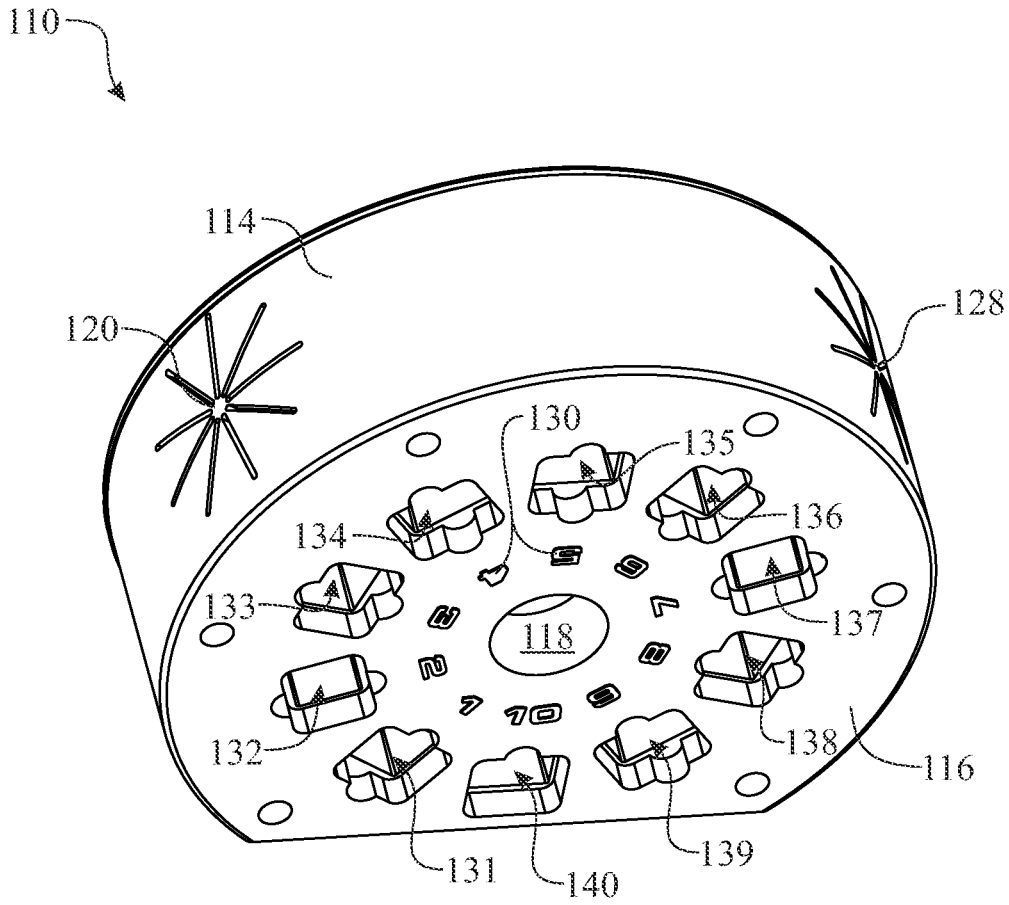
FIG. 2 presents a bottom isometric view of the tree top subassembly of FIG. 1.
Figure 3:
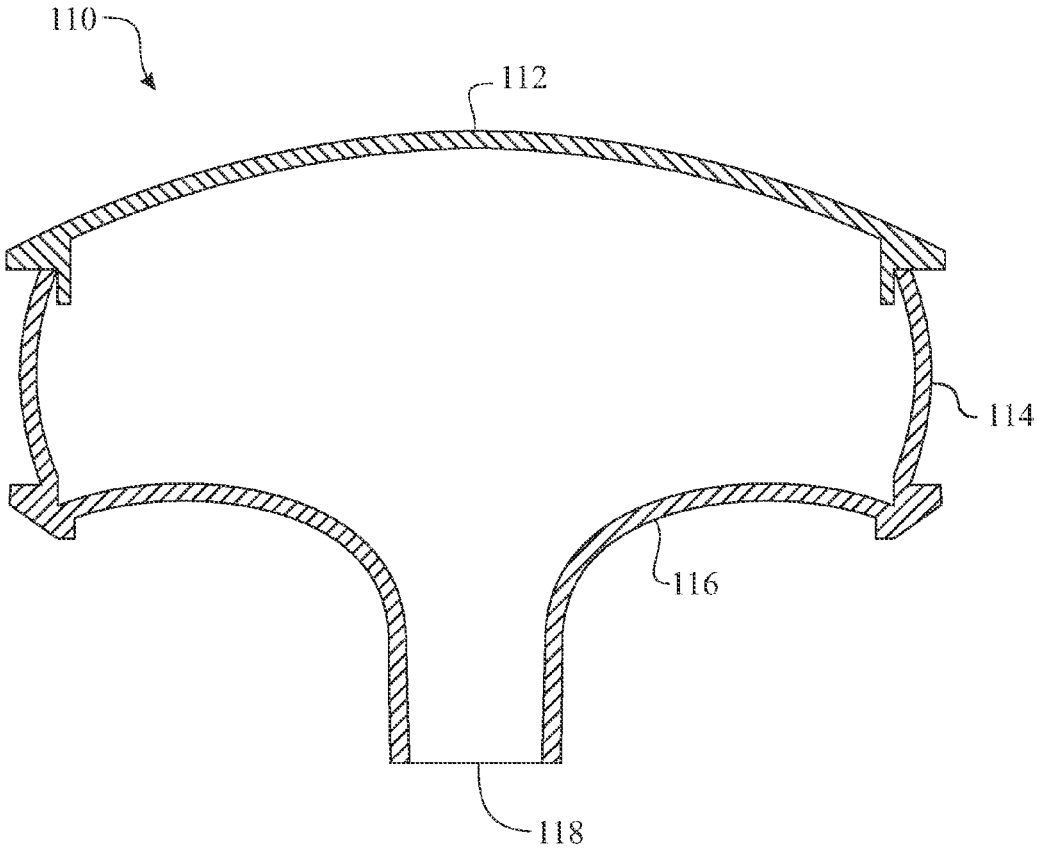
FIG. 3 presents a sectional side elevation view of the tree top subassembly of FIG. 1, the section take along a vertical centerline.
Figure 4:
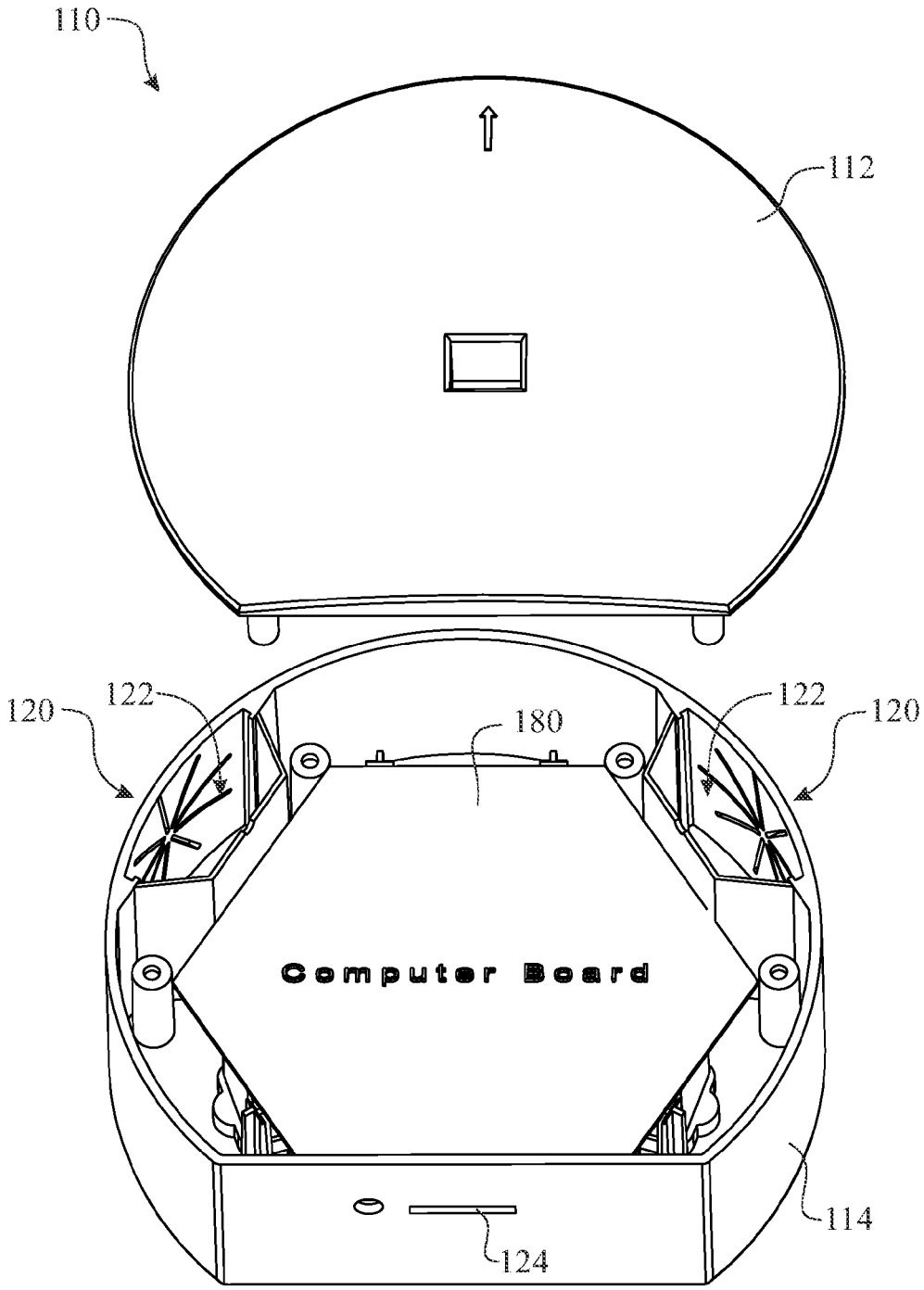
FIG. 4 presents a top isometric view of the tree top subassembly of FIG. 1, shown in an opened configuration.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

A first exemplary light formed Christmas tree 100 is presented throughout the illustrations of FIGS. 1 through 17. The light formed Christmas tree 100 provides a Christmas tree lighting system having an audio output, wherein the lights are choreographed to an audio signal. The light formed Christmas tree 100 integrates several subassemblies to create a Christmas tree frame, including a tree top subassembly 110, a base subassembly 150 in combination with a series of base arm subassemblies 170 to form a complete base assembly 165, and a support column subassembly 190.

The tree top subassembly 110 is detailed in FIGS. 1 through 4. The tree top subassembly 110 is fabricated having a top enclosure 114 sealed by a top cover 112. It is understood that any releasably engaging interface can be used to removably attach the top cover 112 to the top enclosure 114 to provide access to the interior of the tree top subassembly 110.

The top enclosure 114 is preferably provided extending upwards from a perimeter of a top assembly bottom surface 116. A support column receptacle 118 is provided within the top assembly bottom surface 116 providing a means for removably assembling the support column subassembly 190 to the tree top subassembly 110. At least one speaker port 120 is provided through the top enclosure 114, or other reasonable location, for emitting an audio pressure wave. A speaker receptacle 122 is provided on an interior of the tree top subassembly 110 for mounting a speaker (not shown, but well understood) and projecting the audio pressure waves through the speaker port 120. A controller printed circuit board 180 is mounted within the tree top subassembly 110, providing electronic controls for signal outputs, such as the audio output, light operation, and the like. A portable memory card interface 124 is provided through a wall of the top enclosure 114 and in signal communication with the controller printed circuit board 180. It is preferred that the tree top subassembly 110 be fabricated of injection molded plastic.

The tree top subassembly 110 can include optional features to aid in the assembly of the Christmas tree arrangement. A series of light string ports 131-140 can be provided through any structure of the tree top subassembly 110, such as the top assembly bottom surface 116 as illustrated. Each of the light string ports 131-140 can include a light string reference 130 to aid the installer in the assembly of the Christmas tree arrangement. The ports can be of any form factor and reasonable function. One such function can be an electro-mechanical connection. A second such function can be a pull out roll, storing the string of lights. A third function can be an aperture providing access to an electrical connector located within the tree top subassembly 110. The exemplary embodiment presents a series of ten (10) light string ports identified as follows:

TABLE 1

Light Port References

| Light Port No. | Element Ref. No. | Description |
|---|---|---|
| 1 | 131 | First Light String Port |
| 2 | 132 | Second Light String Port |
| 3 | 133 | Third Light String Port |
| 4 | 134 | Fourth Light String Port |
| 5 | 135 | Fifth Light String Port |
| 6 | 136 | Sixth Light String Port |
| 7 | 137 | Seventh Light String Port |
| 8 | 138 | Eighth Light String Port |
| 9 | 139 | Ninth Light String Port |
| 10 | 140 | Tenth Light String Port |

Figure 5:
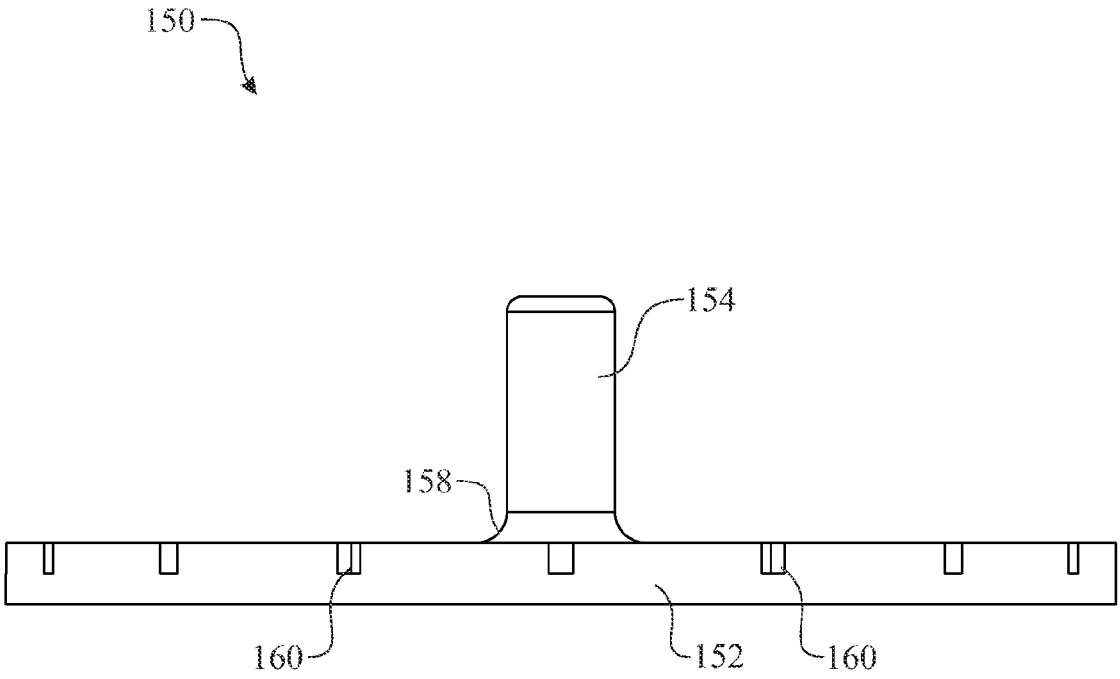
FIG. 5 presents a side elevation view of an exemplary tree base subassembly for use in conjunction with a first exemplary embodiment of a light formed Christmas tree.
Figure 6:
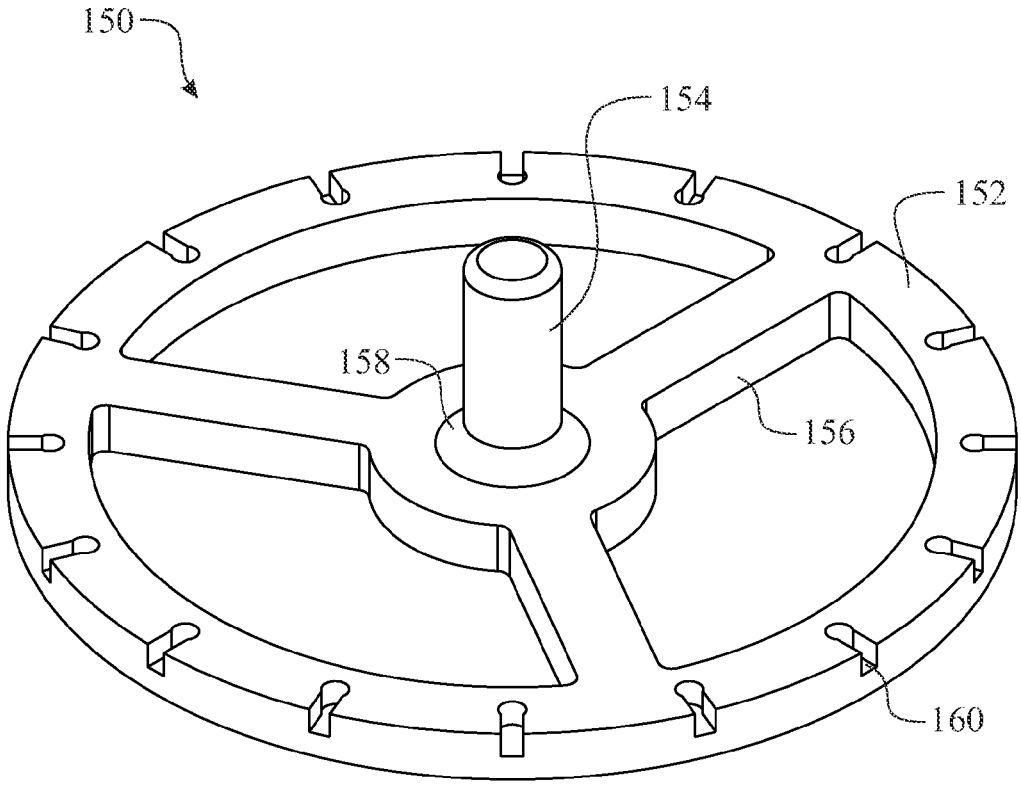
FIG. 6 presents a top isometric view of the tree base subassembly of FIG. 5.

The base subassembly 150 is detailed in FIGS. 5 and 6. The base subassembly 150 comprises a central base section 158 is provided, preferably centered to a base ring 152 via a base support framing 156. A support column interface 154 extends upwards from a central base section 158 for receiving a lower end of the support column subassembly 190. The first exemplary embodiment provides a series of base arm subassemblies 170 assembled about a perimeter of the base ring 152. A plurality of pivotal arm receptacle 160 is spatially provided about the perimeter of the base ring 152 for receiving the base arm subassemblies 170. The base subassembly 150 can be fabricated of molded plastic, formed metal, shaped plastic or metal, molded composites, and the like.

Figure 7:
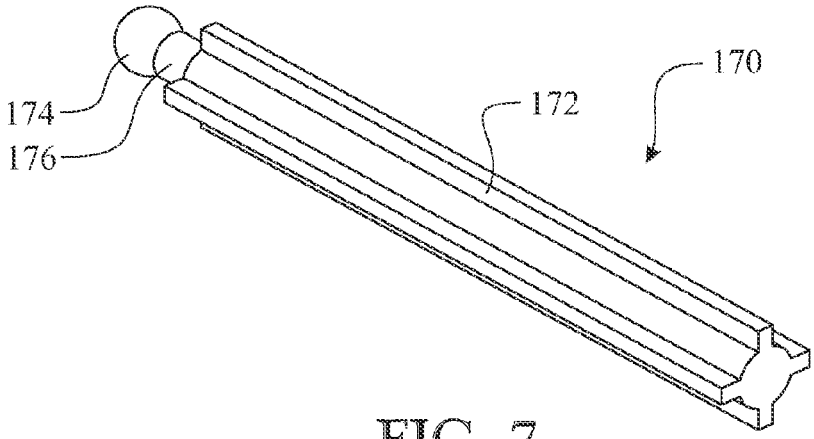
FIG. 7 presents an isometric view of an exemplary embodiment of a base arm subassembly.
Figure 8:
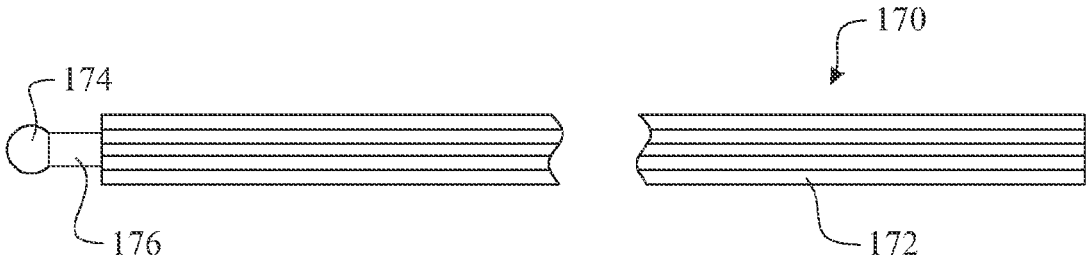
FIG. 8 presents a side elevation view of the base arm subassembly of FIG. 7.
Figure 9:
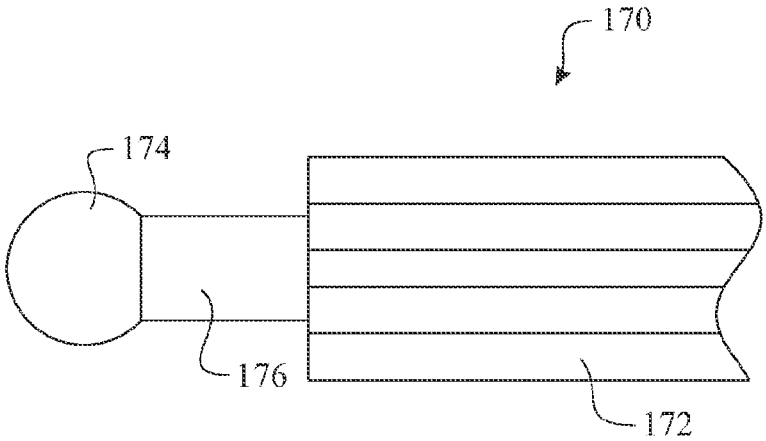
FIG. 9 presents a magnified side elevation view of a ball connection end of the base arm assembly of FIG. 7.
Figure 10:
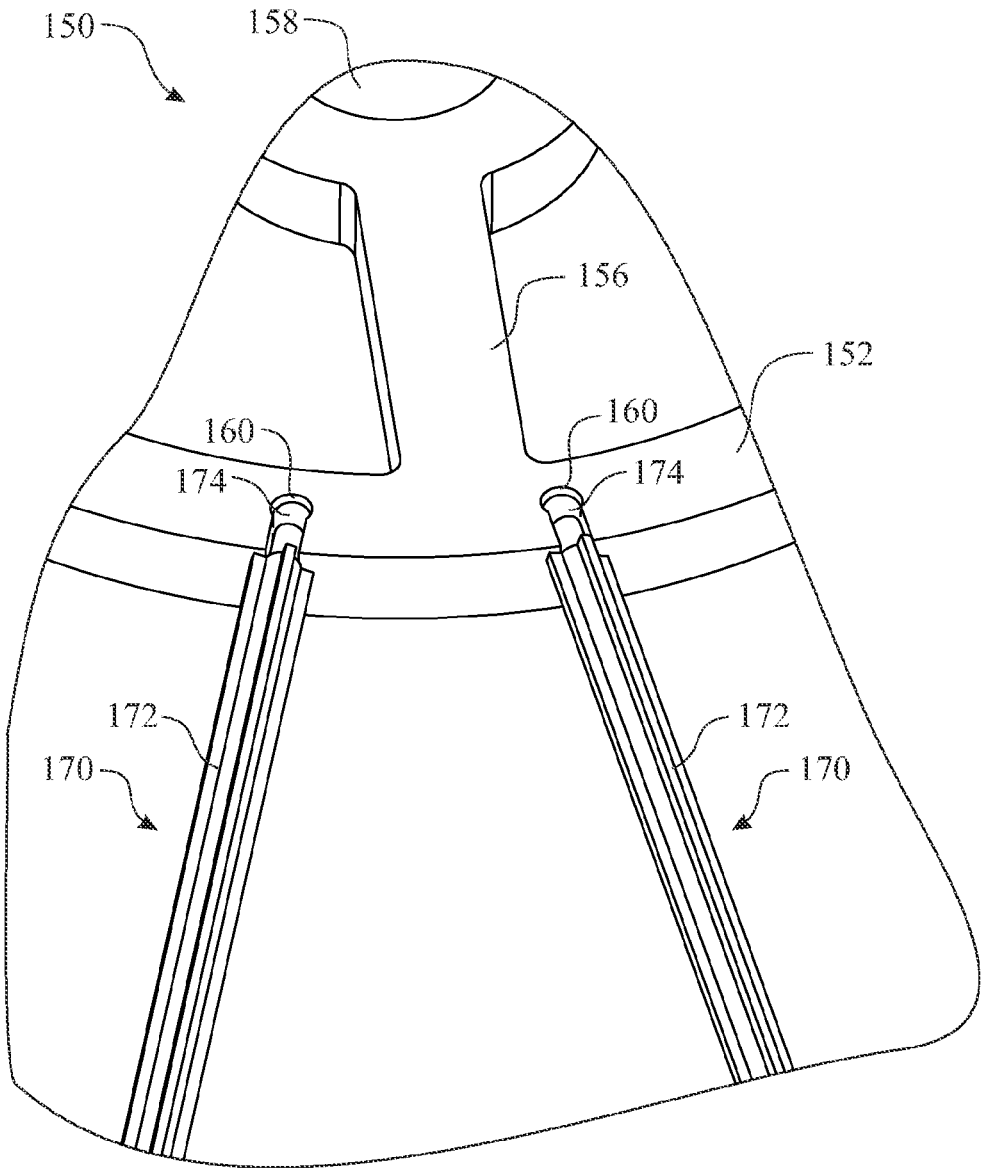
FIG. 10 presents a top isometric view detailing the assembly interface between the base arm subassembly of FIG. 7 and the tree base subassembly of FIG. 5.
Figure 11:
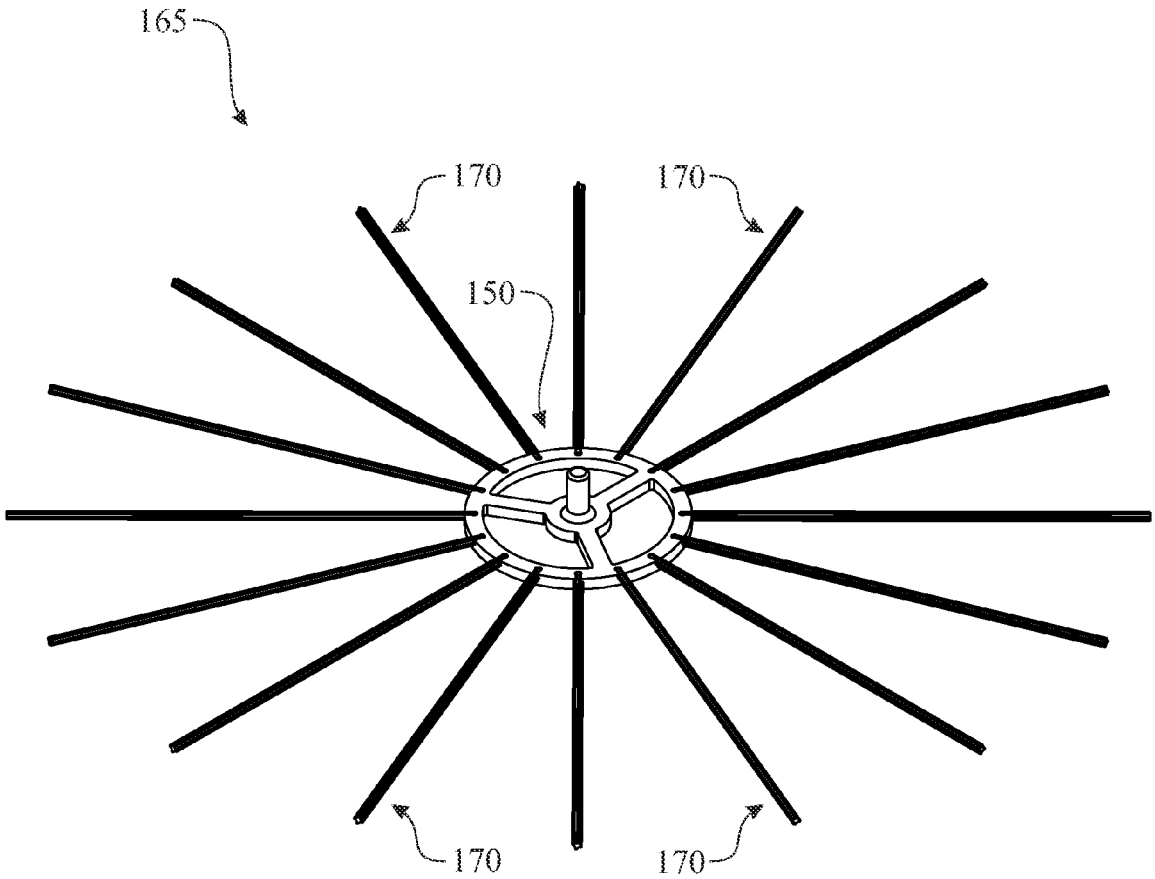
FIG. 11 presents a top isometric view illustrating the complete base assembly.
Figure 12:
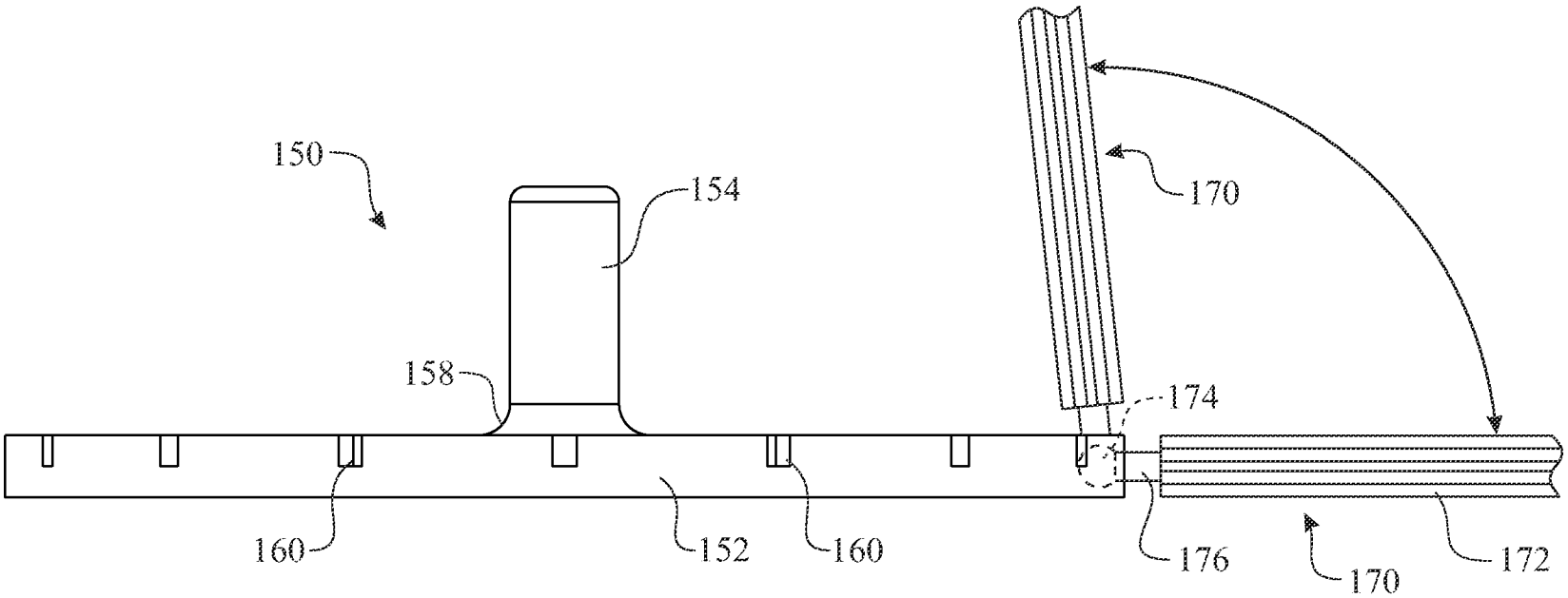
FIG. 12 presents a pivotal assembly provided between the base arm subassembly and the tree base subassembly.

The base arm subassembly 170 is detailed in FIGS. 7 through 9, with the assembly of the base arm subassembly 170 into the base subassembly 150 being detailed in FIGS. 10 through 12. The base arm subassembly 170 includes a ball joint 174 located at a proximal end of a base arm 172. A ball joint mount 176 positions the ball joint 174 at a distance from the end of the base arm 172 providing clearance for rotation after assembly. The base arm 172 can be of any cross-sectional shape, including a modified "+" as illustrated, a tube, a rectangular tube, a round tube, round bar, rectangular bar, triangular, and the like. The base arm subassembly 170 can be fabricated of any reasonable material, including metal, plastic, composites, and the like. The ball joint 174 is inserted into the pivotal arm receptacle 160. An optional cover plate (not shown, but well understood) can be assembled to the surface of the base ring 152 ensuring the ball joint 174 remains engaged with the pivotal arm receptacle 160. The pivotal arm receptacle 160 to ball joint 174 interface allows the base arm subassembly 170 to pivot for storage, as illustrated in FIG. 12. The optional cover plate can rotate to lock the base arm subassemblies 170 from pivoting into the storage configuration. The complete series of base arm subassemblies 170 are shown installed in FIG. 11. A first end of a string of lights is attached to the distal end of each of the base arm subassembly 170, with a second end being attached to the tree top subassembly 110, as illustrated in FIG. 17.

Figure 13:
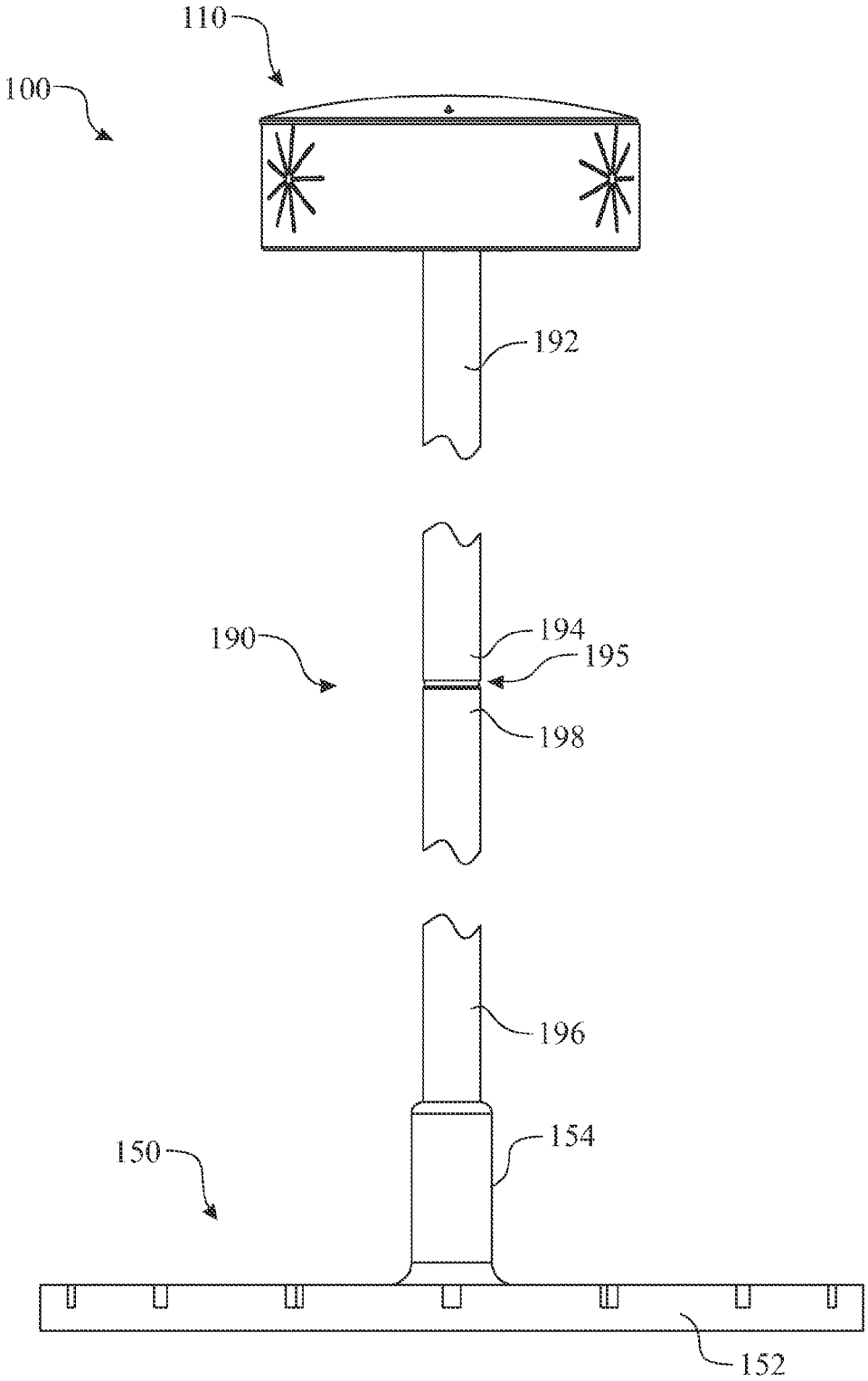
FIG. 13 presents a side elevation view of an exemplary light formed Christmas tree frame assembly, comprising the tree top subassembly of FIG. 1, the tree base subassembly of FIG. 5, and a support column subassembly.
Figure 14:
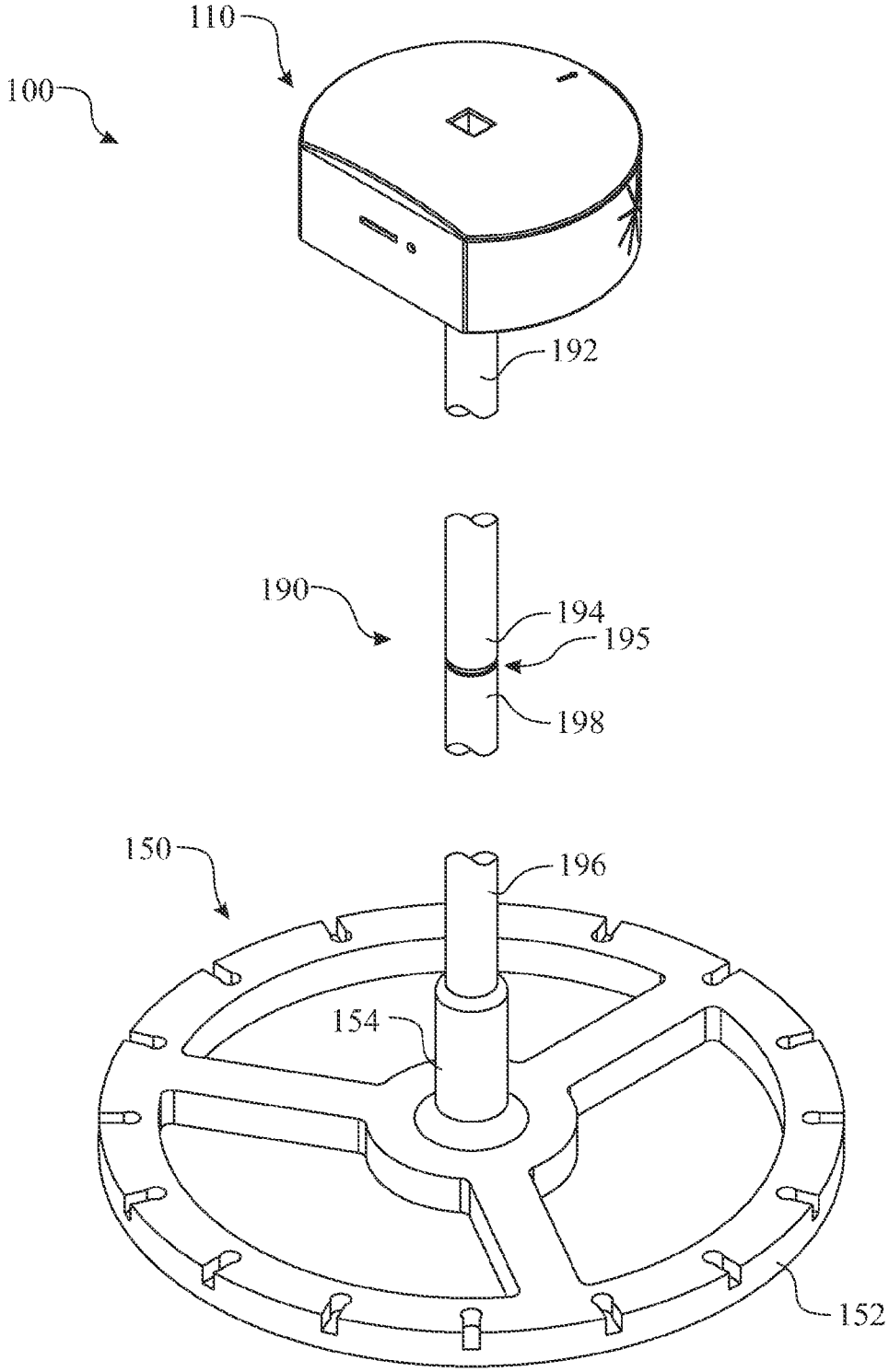
FIG. 14 presents a top isometric view of an exemplary light formed Christmas tree frame assembly of FIG. 13.
Figure 17:
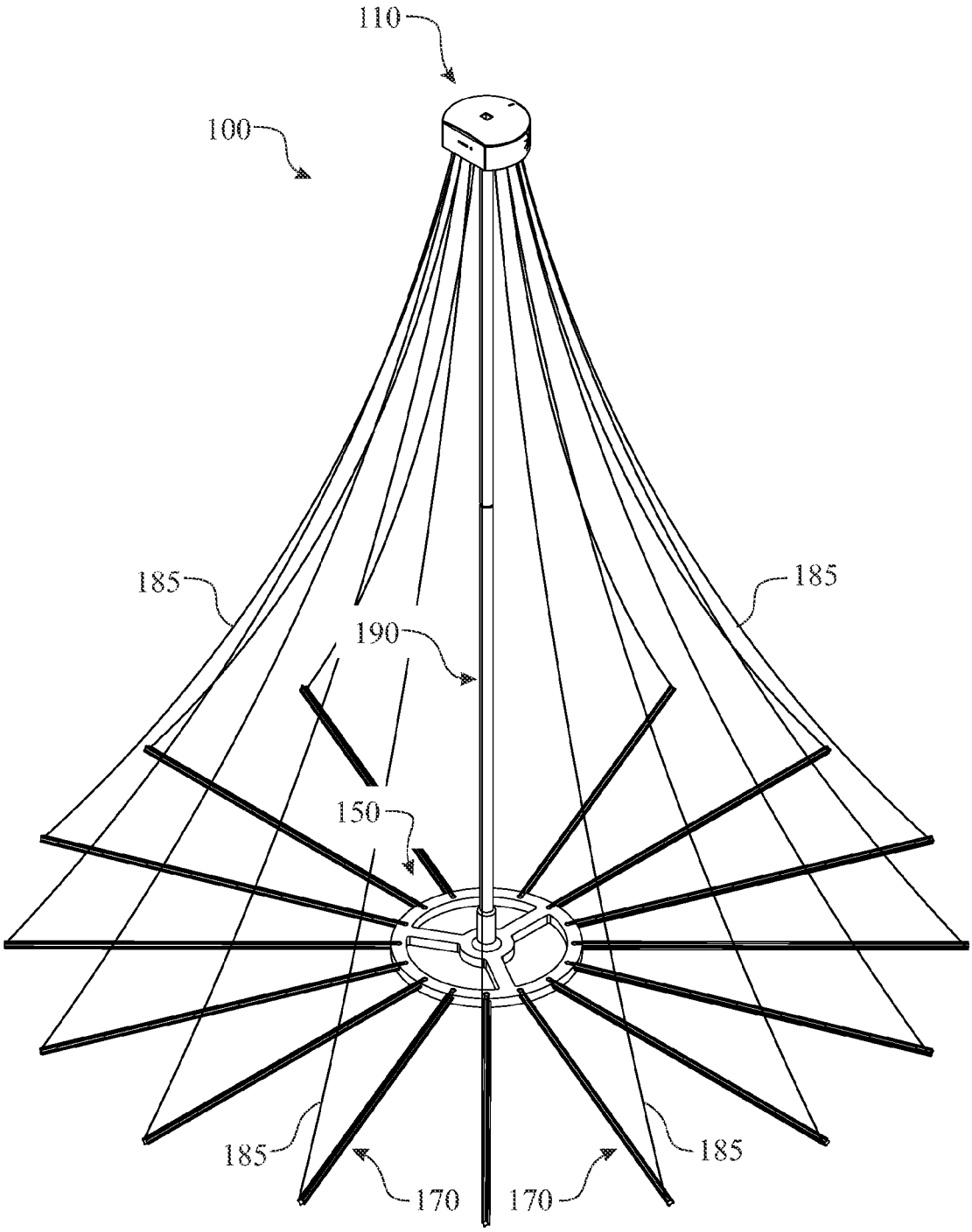
FIG. 17 presents an isometric view of a exemplary light formed Christmas tree integrating lights into the frame assembly of FIG. 13.
Figure 18:
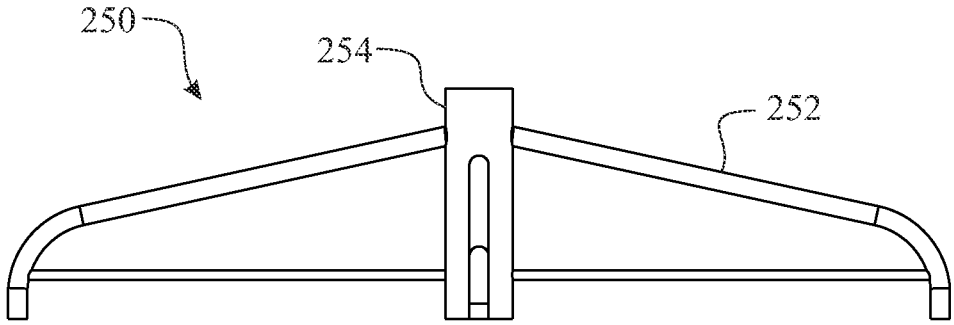
FIG. 18 presents a side elevation view of an exemplary tree base subassembly for use in conjunction with a second exemplary embodiment of a light formed Christmas tree.
Figure 19:
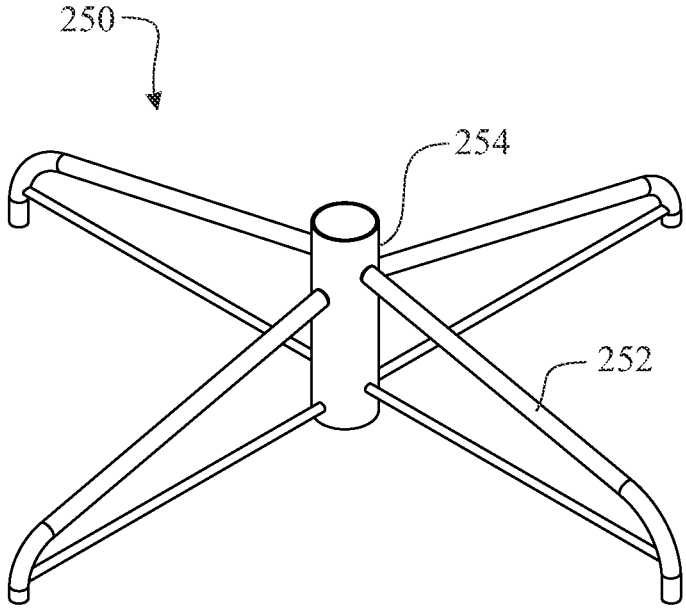
FIG. 19 presents a top isometric view of the tree base subassembly of FIG. 18.

The assembled light formed Christmas tree 100 is illustrated in FIGS. 13 and 14, further adding the lights as illustrated in FIG. 17. A support column subassembly 190 comprises an upper support column member 192 being assembled to a lower support column member 196 via a support column-coupling interface 195. The support column coupling interface 195 is provided via a upper coupling member 194 and a lower coupling member 198, wherein the upper coupling member 194 and lower coupling member 198 are removably engaging with one another for repeated assembly and disassembly of the support column subassembly 190. The upper coupling member 194 is provided at a lower end of the upper support column member 192. The lower coupling member 198 is provided at an upper end of the lower support column member 196. It is understood the upper support column member 192 and lower support column member 196 can be slideably assembled or telescoping, allowing for height adjustment and ease of storage. It is understood that the support column-coupling interface 195 can further comprise a height adjusting mechanism. An upper end of the upper support column member 192 is inserted into the support column receptacle 118 of the tree top subassembly 110. A lower end of the lower support column member 196 is inserted into the support column interface 154 of the base subassembly 150. It is recognized that a plurality of support column coupling interfaces 195 can be utilized to vary the height of the light formed Christmas tree 100. A series of light strands 185 are disposed about the supporting frame assembly. The light strands 185 can be any commonly available strand of Christmas lights, including incandescent bulbs, LED's, single color, multi-colored, color changing LED's, ribbon lighting, and the like. A power end of the each light strand 185 is in electro-mechanical communication with the tree top subassembly 110. A distal end of the each light strand 185 is secured to a distal end of the base arm subassembly 170. The series of light strands 185 forms a conical shape being representative of a Christmas tree.

The controller printed circuit board 180 provides the functional utility of the light formed Christmas tree 100. An assembly illustration of the topside of the controller printed circuit board 180 is presented in FIG. 15. An assembly illustration of the bottomside of the controller printed circuit board 180 is presented in FIG. 16. Functionality of the controller printed circuit board 180 will be presented in the description associated with FIG. 24.

Figure 20:
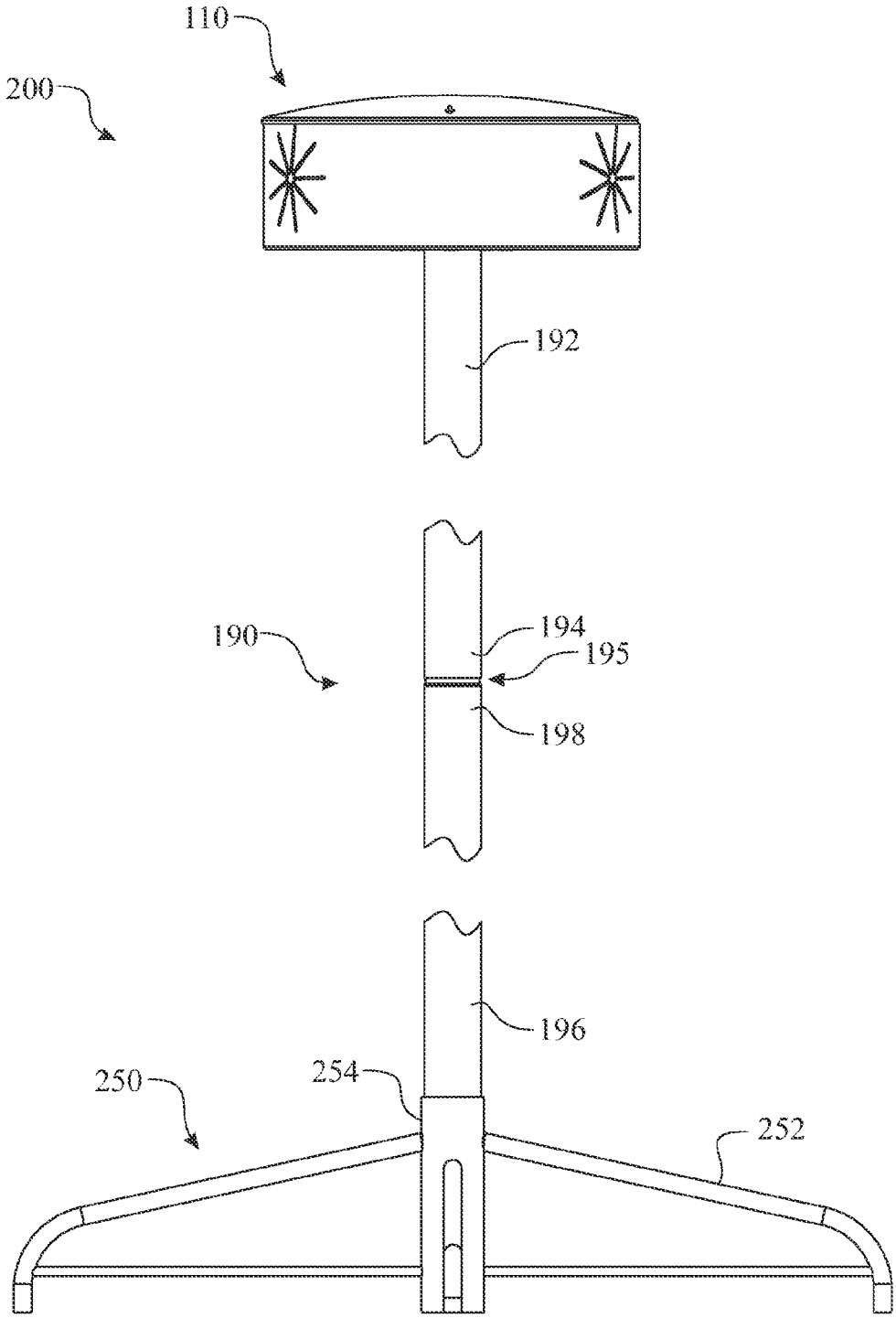
FIG. 20 presents a side elevation view of an exemplary light formed Christmas tree frame assembly, comprising the tree top subassembly of FIG. 1, the tree base subassembly of FIG. 18, and a support column subassembly.
Figure 21:
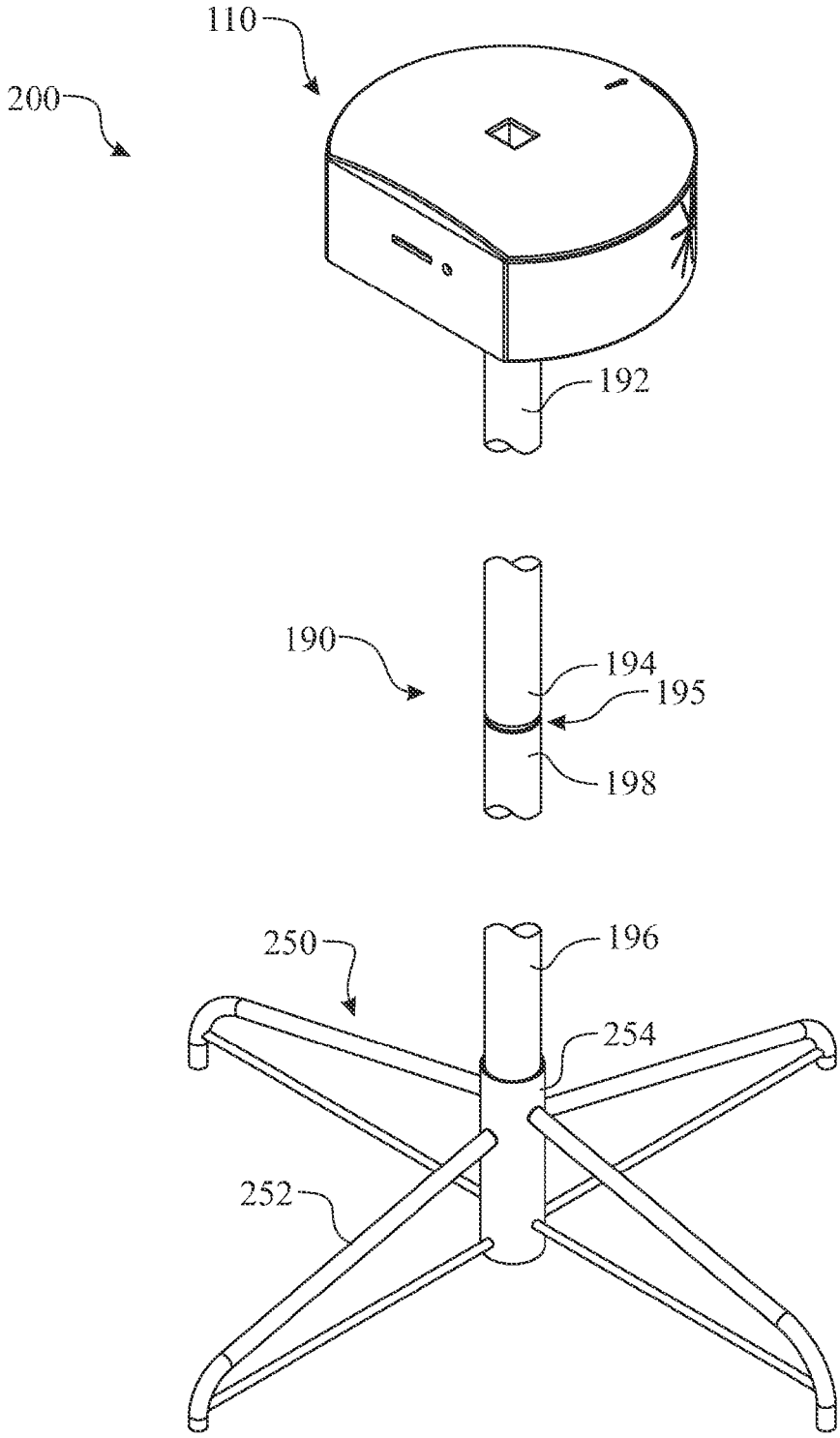
FIG. 21 presents a top isometric view of an exemplary light formed Christmas tree frame assembly of FIG. 20.
Figure 22:
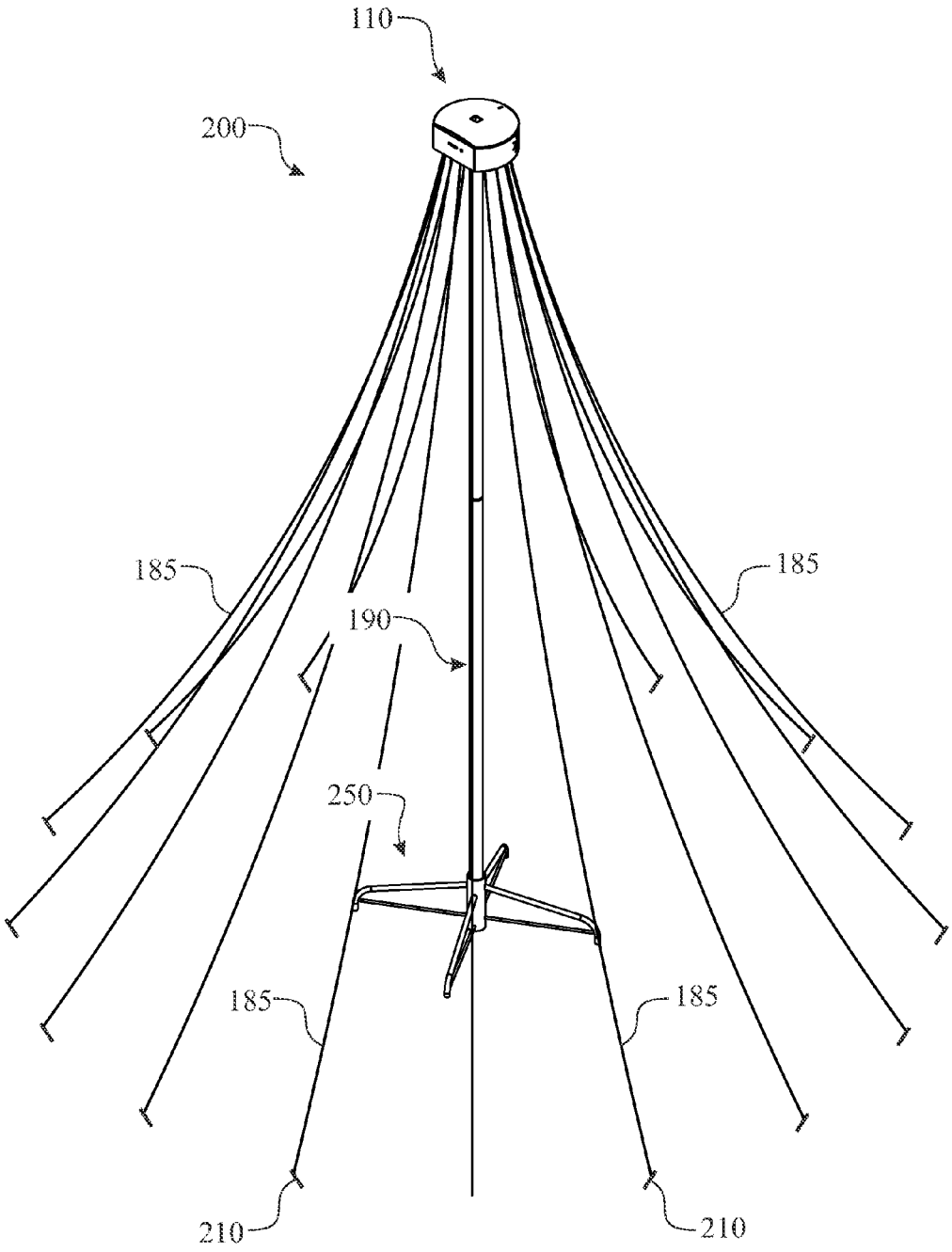
FIG. 22 presents an isometric view of a second exemplary light formed Christmas tree integrating lights into the frame assembly of FIG. 20.

A second exemplary embodiment is presented as a light formed Christmas tree 200 illustrated in FIG. 22. The light formed Christmas tree 200 eliminates the need for the base arm subassemblies 170; therefore the light formed Christmas tree 200 can utilize a more cost conscience base assembly 250. The base subassembly 250 comprises a plurality of base supporting legs 252 assembled to a support column interface 254. The lower end of the support column subassembly 190 is assembled to the support column interface 254. It is understood that any reasonably sized and shaped base subassembly 250 can be used for supporting the light formed Christmas tree 200, as illustrated in FIGS. 20 and 21. The balance of the assembly is consistent with the light formed Christmas tree 100 described via FIGS. 13 and 14. Similar to the first embodiment, a series of light strands 185 are disposed about the supporting frame assembly. A power end of the each light strand 185 is in electro-mechanical communication with the tree top subassembly 110. A distal end of the each light strand 185 is secured to the ground via a stake 210. It is understood the stakes 210 can be of any common form factor. It would be desirable that each light strand 185 comprises a loop at the distal end for aiding in engagement with the stake 210. The series of light strands 185 are arranged to form a conical shape being representative of a Christmas tree.

Figure 23:
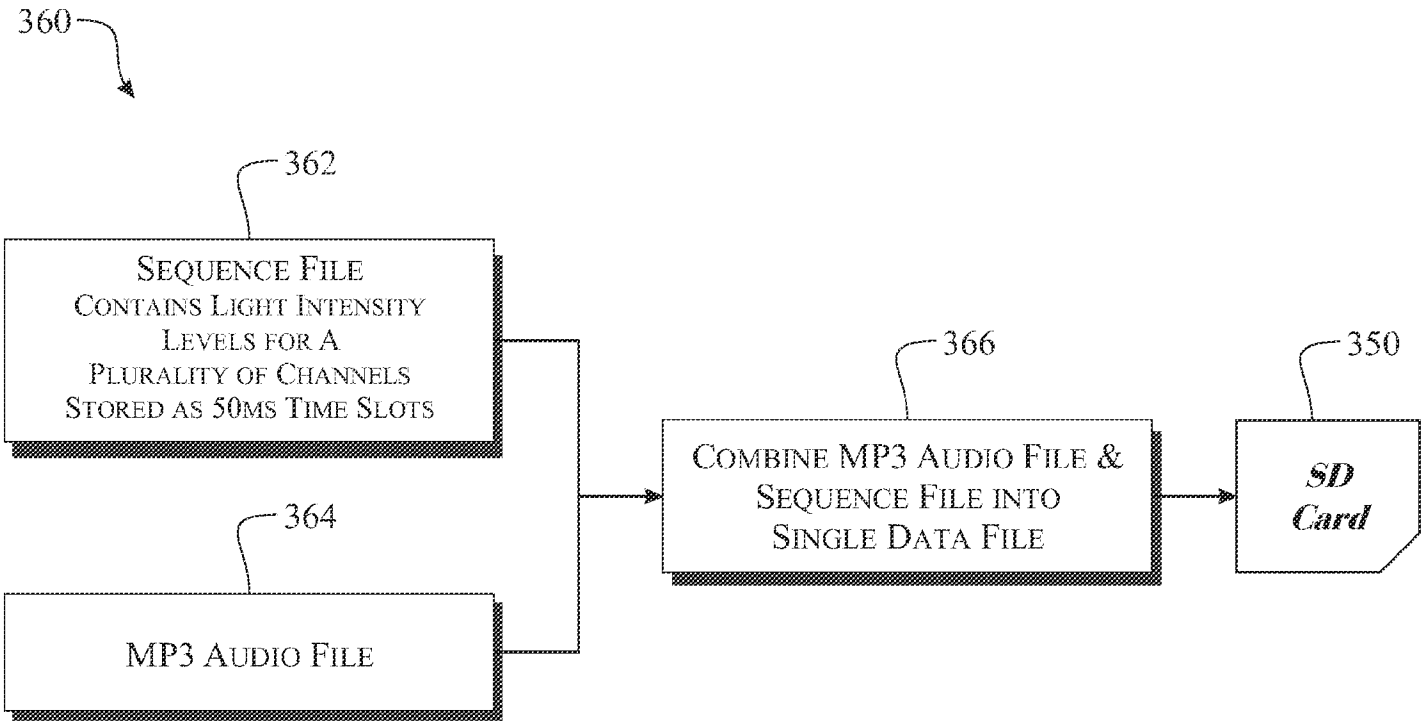
FIG. 23 presents a flow diagram representative of an audio-light controlling data file.

The light formed Christmas tree 100, 200 operate utilizing a tree operational controller data file 366, wherein the tree operational controller data file 366 is generated in accordance with a tree operational file generating flow diagram 360 presented in FIG. 23. The tree operational controller data file 366 is created by integrating a sequence file 362 with an audio file 364. The sequence file 362 contains light intensity level across a plurality of channels. The number of channels can be programmed by the user. The preferred embodiment stores the intensity levels in 50 millisecond time slots. Once the tree operational controller data file 366 is generated, the file is stored on a portable memory card 350, such as an SD card.

Figure 24:
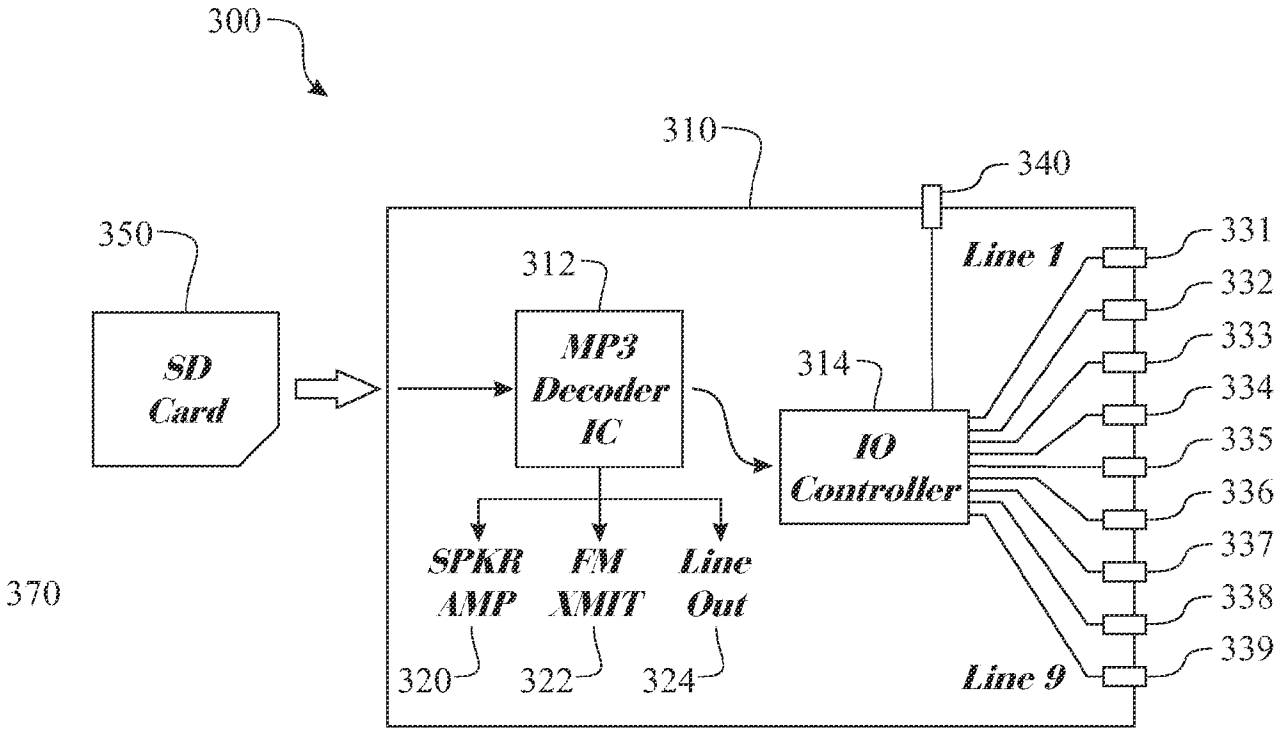
FIG. 24 presents an exemplary block diagram of an audio and light controller.

An audio and light controller 300 is presented in FIG. 24. The audio and light controller 300 comprises a circuit, including an electro-mechanical interface for reading and writing between the circuit and the base subassembly 250. The circuit includes a digital audio decoder integrated circuit 312, which interprets the file and generates and audio output signal. The audio output signal is distributed through any audio distribution means, including a speaker amplifier output 320, a FM transmit output 322, and a line output 324. The speaker amplifier output 320 amplifies the signal to drive a speaker arrangement. The FM transmit output 322 provides a wireless signal to a remote receiving device (not shown, but well understood in the art). The line output 324 provides a signal output to low powered speakers, an amplifier, and the like. The circuit further comprises an input/output controller 314. The sequence file 362 can be interpreted via the digital audio decoder integrated circuit 312, an input/output controller 314, or another device provided within the circuit. The information respective to the sequence file 362, decoded from the tree operational controller data file 366, is then used to generate a signal to drive a series of output ports 331-340 in accordance with the encoded choreographed sequence. A strand or plurality of strands of lights 185 (FIGS. 17 and 22) is connected to each of the series of output ports 331-340. Power is provided to the audio and light controller 300 via a power source 370. It is understood that a power management circuit can be incorporated into the audio and light controller circuitry 310 to manage and distribute power. Power can be provided to the series of output ports 331-340 to power each individual series of lights as programmed. It is understood the each of the output ports 331-340 are associated with a respective light string port 131-140. The following details the light string ports 131-140:

TABLE 2

Output Port References

| Output Port No. | Element Ref. No. | Description |
|---|---|---|
| 1 | 331 | First Output Port |
| 2 | 332 | Second Output Port |
| 3 | 333 | Third Output Port |
| 4 | 334 | Fourth Output Port |
| 5 | 335 | Fifth Output Port |
| 6 | 336 | Sixth Output Port |
| 7 | 337 | Seventh Output Port |
| 8 | 338 | Eighth Output Port |
| 9 | 339 | Ninth Output Port |
| 10 | 340 | Tenth Output Port |

Figure 25:
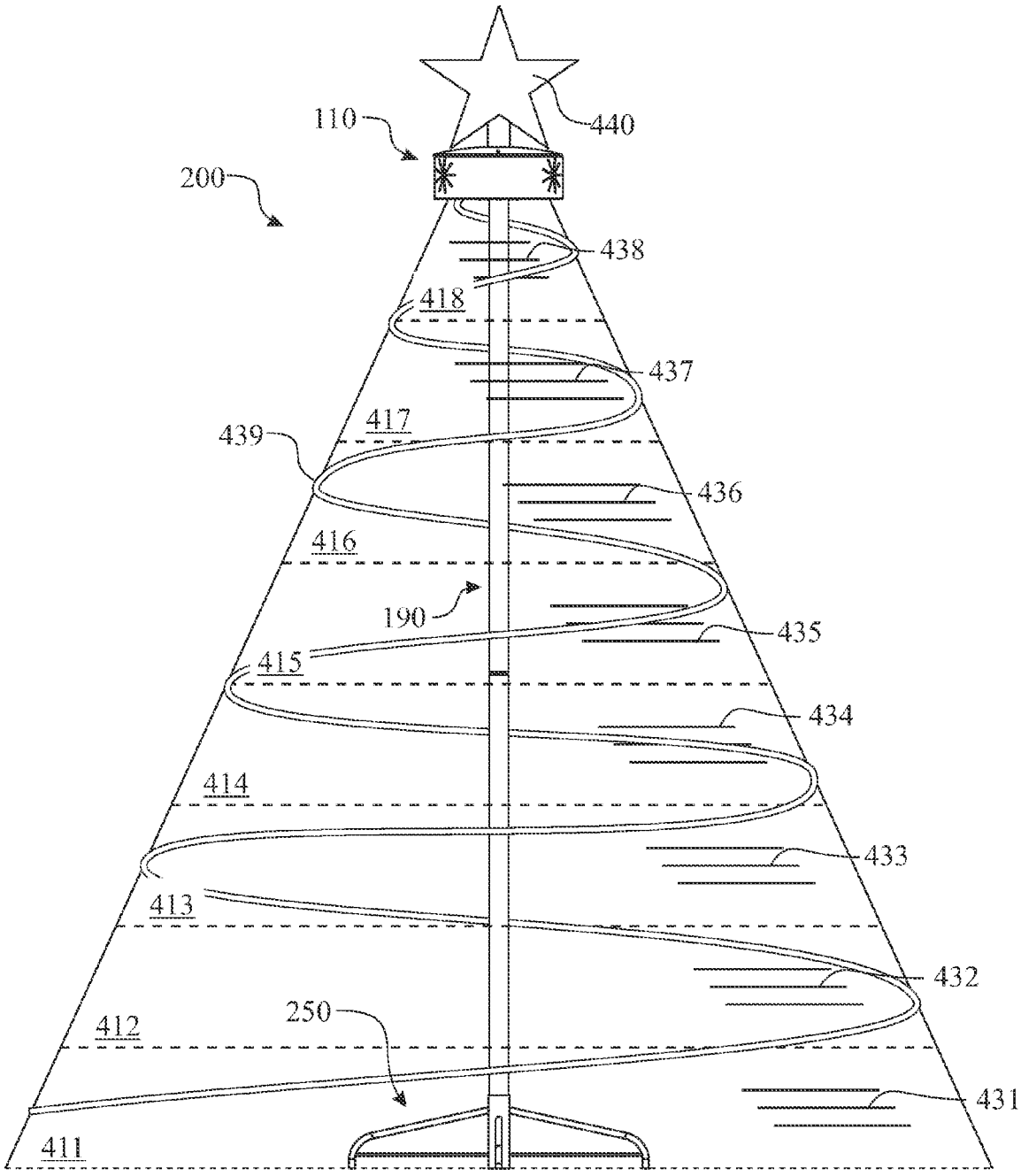
FIG. 25 presents an elevation view of the exemplary light formed Christmas tree defining an exemplary light segmentation.
Figure 26:
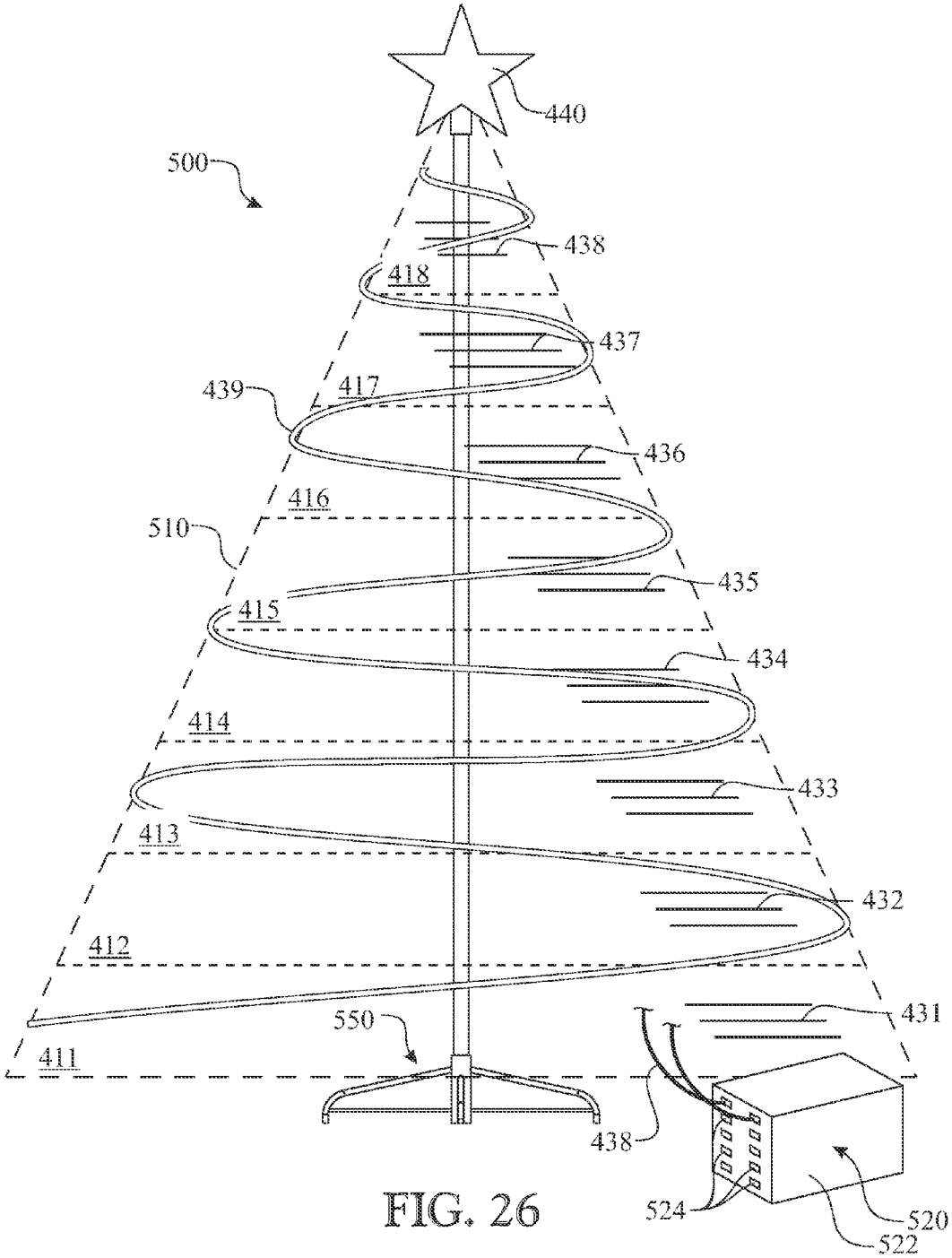
FIG. 26 presents an elevation view of the present invention installed on a natural or artificial Christmas tree.

An exemplary arrangement of lights is presented in FIG. 25, utilising the light formed Christmas tree 200 as a base. A plurality of strands of lights 431-439 are installed onto a Christmas tree, hung from the light formed Christmas tree 200, and the like. The strands of lights 431-438 are arranged in accordance with a desired differentiation, such as layers as illustrated. The presented exemplary embodiment separates the light formed Christmas tree 200 into horizontal layers 411-418. Each strand is connected to a specific port on the audio and light controller 300. The audio and light controller 300 can be provided in a controller box (not shown) to support a configuration for a natural Christmas tree, or within the tree top subassembly 110 as presented. An alternate light strand 439 can be provided having a different color and installed in a configuration that differs from the installation of the strands of lights 431-438. One exemplary installation provides colored lights for the strands of lights 431-438 and a white strand of lights for the alternate light strand 439. A tree topper 440, such as a star, angel, and the like can be provided and connected to another unused port on the audio and light controller 300. The strands of lights 431-438 would be numbered to correspond with the respective output port to aid in the assembly of the light formed Christmas tree 100, 200.

TABLE 3

Exemplary Light Configuration

| Layer | Layer Ref. | Light Strand Ref. | Color | Connection Port |
|---|---|---|---|---|
| 1 | 411 | 431 First Light Strand | Colored | 331 First Output Port |
| 2 | 412 | 432 Second Light Strand | Colored | 332 Second Output Port |
| 3 | 413 | 433 Third Light Strand | Colored | 333 Third Output Port |
| 4 | 414 | 434 Fourth Light Strand | Colored | 334 Fourth Output Port |
| 5 | 415 | 435 Fifth Light Strand | Colored | 335 Fifth Output Port |
| 6 | 416 | 436 Sixth Light Strand | Colored | 336 Sixth Output Port |
| 7 | 417 | 437 Seventh Light Strand | Colored | 337 Seventh Output Port |
| 8 | 418 | 438 Eighth Light Strand | Colored | 338 Eighth Output Port |
| 9 | 419 | 439 Ninth Light Strand | White | 339 Ninth Output Port |
| 10 | Tree Topper | 440 Tree Topper | Any | 340 Tenth Output Port |

Figure 15:
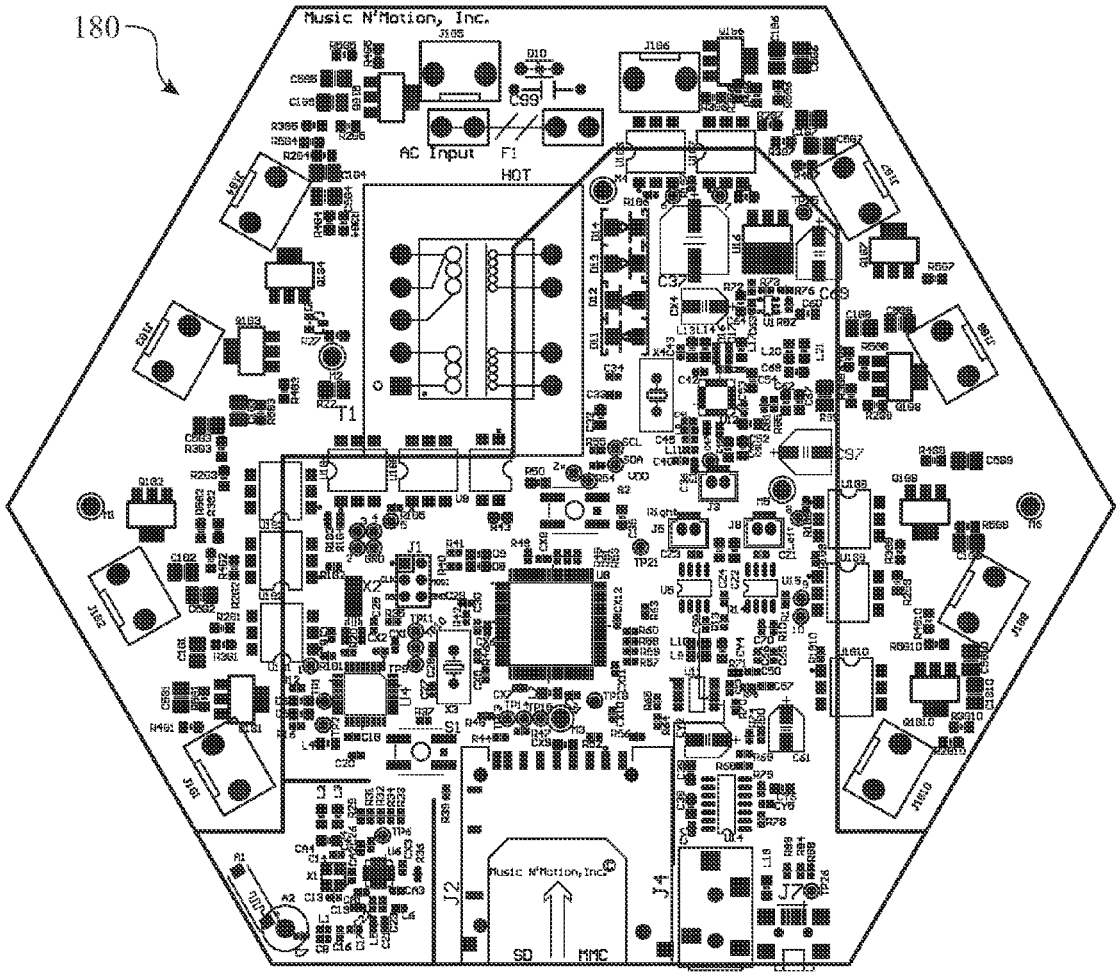
FIG. 15 presents a top planar view combining a silk screen layer and a solder mask opening layer of an exemplary printed circuit board
Figure 16:
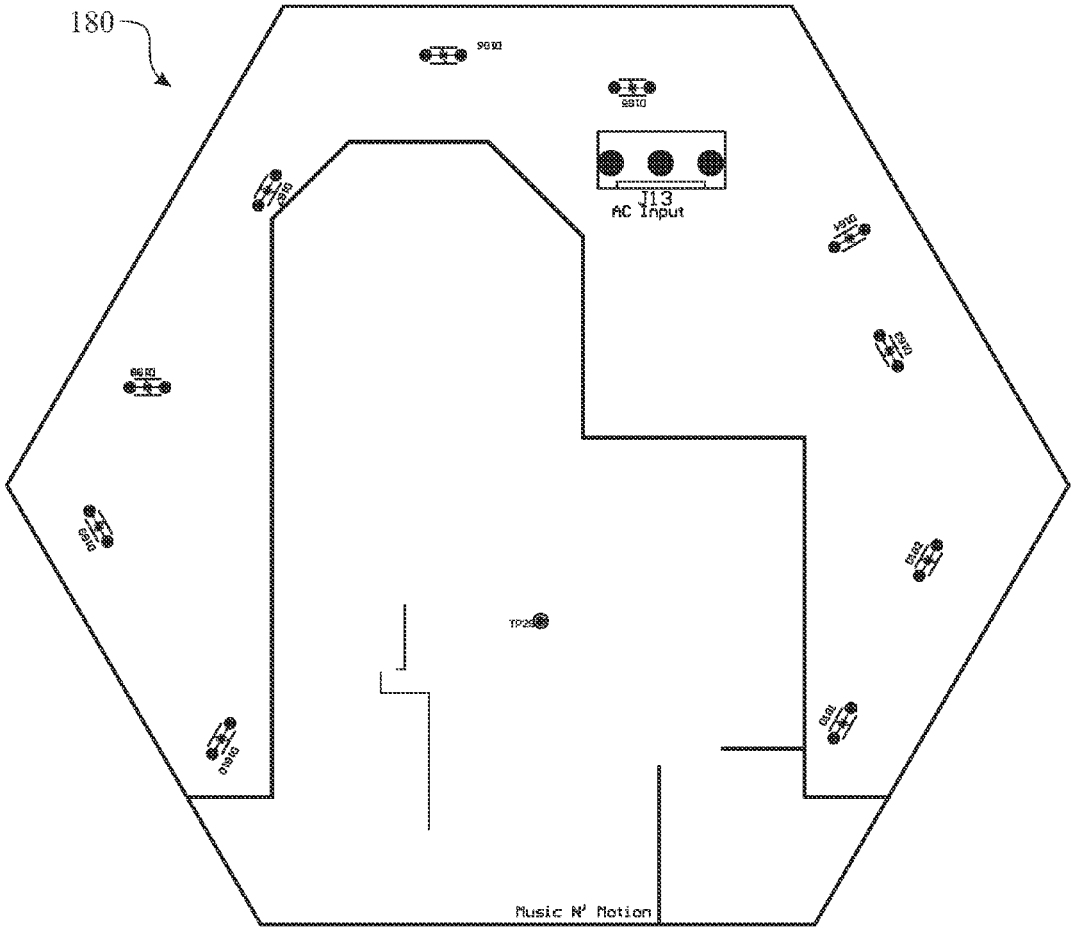
FIG. 16 presents a bottom planar view combining a silk screen layer and a solder mask opening layer of the exemplary printed circuit board of FIG. 15.

The above teaches a decorative apparatus providing a series of lights forming a shape resembling a Christmas tree. The present invention can be adapted to provide a tree decorating apparatus 500 to be installed onto a natural Christmas tree or an artificial Christmas tree, both being represented by Christmas tree 510. The Christmas tree 510 is placed in to a tree stand 550. The series of lights 431-438 would be either pre-installed onto the artificial tree or manually installed onto either the natural tree or artificial tree. A portable controller subassembly 520 is provided, having functional features similar to the controller of the tree top subassembly 110, while being housed in a controller housing 522 having a form factor which can be placed under the tree 500. The portable controller subassembly 520 includes a series of light string ports 524 that are similar to the light string ports 131-140 in signal communication with a controller printed circuit board 180 (FIGS. 15 and 16). Each of the light strings 131-140 are provided in electrical communication with a respective light string port 524 of the portable controller subassembly 520. The illustration includes a representative connection of exemplary light string 438 in electrical communication with one of the series of light string ports 524. The balance of the connections are well understood, but not shown for clarity. The lighting arrangement and characteristics can be configured and operated as described in the embodiment detailed in FIG. 25. The lights are preferably preinstalled onto the artificial version of the Christmas tree 510. Each light strand 431-439 would include a numbered plug associated with a specific light string port 524. This provides the end user with a simple, quick, and repeatable assembly process. The artificial tree can include hinged limbs allowing the Christmas tree 510 to collapse for easy conversion to a storage configuration. Alternately, the user can install the lights onto a natural Christmas tree 510 in accordance with an instruction manual and respective labeling of the strings 431-439. A tree topper 440 can be coupled to the controller subassembly 520 into a specific port identified for use in conjunction with the tree topper 440. Although the light strings 431-439 are shown in a specific arrangement, the user can install the light strings in any desired configuration while taking some considerations to the controller output.

The light formed Christmas tree 100, 200 can be operably controlled via a remote control. The system can include various modes of operation, including a constant on (referred to as a steady burn mode), clear lights only (such as ninth light strand 439), colored lights only (such as the first through the eighth light strands 431-438), animated in lights only, animated with music, and animated at various speeds. Additionally, a plurality of light formed Christmas tree 100, 200 can be synchronized via a wired or wireless communication between control units.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

We claim:

1. An entertainment device for use with a Christmas tree, the entertainment device comprising:

a plurality of lighting strings to be positioned on the Christmas tree, each lighting string comprising a power input plug and a string of lights coupled thereto;

a plurality of electrical power connectors receiving respective power input plugs of said plurality of said lighting strings;

an audio output device;

a portable file storage device having stored thereon a plurality of audio files and a plurality of associated choreographed lighting sequence files, each choreographed lighting sequence file comprising data representative of different channels for the plurality of lighting strings;

at least one decoder cooperating with said portable file storage device to decode a selected audio file and associated choreographed lighting sequence file from among the pluralities thereof;

audio output circuitry coupled between said at least one decoder and said audio output device to play the decoded selected audio file through said audio output device; and lighting sequence output circuitry coupled between said at least one decoder and said plurality of electrical connectors to control power output to each lighting string based upon the decoded selected choreographed sequence file and in synchronism with the playing of the decoded selected audio file.

2. The entertainment device according to claim 1 further comprising a housing carrying said plurality of electrical connectors, said at least one decoder, said audio output circuitry, and said lighting sequence output circuitry.

3. The entertainment device according to claim 2 wherein said housing further carries said audio output device.

4. The entertainment device according to claim 2 wherein said housing is configured to be positioned at a top of the Christmas tree.

5. The entertainment device according to claim 2 wherein said housing is configured to be positioned at a base of the Christmas tree.

6. The entertainment device according to claim 1 wherein said at least one decoder comprises an MP3 decoder.

7. The entertainment device according to claim 1 wherein said portable file storage device comprises a SIM card.

8. The entertainment device according to claim 1 wherein at least some of said plurality of light strings have different colors.

9. The entertainment device according to claim 1 further comprising a wireless transmitter coupled to said audio output circuitry.

10. The entertainment device according to claim 1 wherein said audio output circuitry comprises an audio amplifier.

11. The entertainment device according to claim 1 further comprising:

a wireless receiver coupled to said at least one decoder, said audio output circuitry and said lighting sequence output device; and a remote controller in wireless communication with said wireless receiver.

12. The entertainment device according to claim 1 further comprising a power regulation circuit coupled to said lighting sequence output circuitry.

13. An entertainment device for use with a Christmas tree, the entertainment device comprising:

a housing;

a plurality of electrical power connectors carried by said housing to receive respective power input plugs for a plurality of said lighting strings, the plurality of lighting strings to be positioned on the Christmas tree;

an interface carried by said housing to receive a portable file storage device, the portable file storage device having stored thereon a plurality of audio files and a plurality of associated choreographed lighting sequence files, each choreographed lighting sequence file comprising data representative of different channels for the plurality of lighting strings;

an audio output device carried by said housing;

at least one decoder carried by said housing and cooperating with said portable file storage device to decode a selected audio file and associated choreographed lighting sequence file from among the pluralities thereof;

audio output circuitry carried by said housing and coupled between said at least one decoder and said audio output device to play the decoded selected audio file through said audio output device; and lighting sequence output circuitry carried by said housing and coupled between said at least one decoder and said plurality of electrical connectors to control power output to each lighting string based upon the decoded selected choreographed sequence file.

14. The entertainment device according to claim 13 wherein said housing is configured to be positioned at a top of the Christmas tree.

15. The entertainment device according to claim 13 wherein said housing is configured to be positioned at a base of the Christmas tree.

16. The entertainment device according to claim 13 wherein said at least one decoder comprises an MP3 decoder.

17. The entertainment device according to claim 13 wherein said portable file storage device comprises a SIM card.

18. An entertainment device for use with a Christmas tree, the entertainment device comprising:

a housing;

a plurality of electrical power connectors carried by said housing to receive respective power input plugs for a plurality of said lighting strings, the plurality of lighting strings to be positioned on the Christmas tree;

an interface carried by said housing to receive a portable file storage device, the portable file storage device having stored thereon a plurality of audio files and a plurality of associated choreographed lighting sequence files, each choreographed lighting sequence file comprising data representative of different channels for the plurality of lighting strings;

an audio output device carried by said housing;

at least one decoder carried by said housing and cooperating with said portable file storage device to decode a selected audio file and associated choreographed lighting sequence file from among the pluralities thereof, said at least one decoder comprising an MP3 decoder;

audio output circuitry carried by said housing and coupled between said at least one decoder and said audio output device to play the decoded selected audio file through said audio output device; and lighting sequence output circuitry carried by said housing and coupled between said at least one decoder and said plurality of electrical connectors to control power output to each lighting string based upon the decoded selected choreographed sequence file.

19. The entertainment device according to claim 18 wherein said housing is configured to be positioned at a top of the Christmas tree.

20. The entertainment device according to claim 18 wherein said housing is configured to be positioned at a base of the Christmas tree.

* * * * *